United States Patent [19]

Radtke et al.

[11] 4,195,002

[45] Mar. 25, 1980

[54] WATER-DISPERSIBLE COATINGS CONTAINING BORON NITRIDE FOR STEEL CASTING DIES

[75] Inventors: Schrade F. Radtke, New Canaan, Conn.; Dodd S. Carr, Newark, N.J.; Max Kronstein, Bronx, N.Y.

[73] Assignee: International Lead Zinc Research Organization, Inc., New York, N.Y.

[21] Appl. No.: 928,725

[22] Filed: Jul. 27, 1978

[51] Int. Cl.[2] ..... C08J 3/06; C08L 9/04; C08L 9/08; C08L 67/06

[52] U.S. Cl. ..... 260/29.2 E; 252/25; 260/29.6 CM; 260/29.7 AT; 260/40 R; 260/42; 260/43; 260/42.47; 260/42.52; 427/135

[58] Field of Search ..... 260/29.2 E, 29.6 CM, 260/29.7 AT; 427/135; 252/25

[56] References Cited

U.S. PATENT DOCUMENTS

| | | | |
|---|---|---|---|
| 2,726,160 | 12/1955 | Ueltz | 252/313 R |
| 2,748,030 | 5/1956 | Silveisher et al. | 260/375 B |
| 2,923,091 | 2/1960 | Ryznar | 427/135 |
| 3,050,490 | 8/1963 | Nitzsche et al. | 260/375 B |
| 3,253,932 | 5/1966 | White | 106/38.27 |
| 3,342,249 | 9/1967 | Ulmer et al. | 427/135 |
| 3,447,588 | 6/1969 | Niskovscikh | 164/73 |
| 3,620,290 | 4/1970 | Kress | 164/73 |
| 3,685,986 | 8/1972 | Sovlievich | 164/73 |
| 3,709,459 | 1/1973 | Bushrod | 249/134 |
| 3,727,666 | 4/1973 | Vander | 164/72 |
| 3,755,232 | 8/1973 | Rodaway et al. | 260/29.7 AT |
| 3,895,899 | 7/1975 | Weber | 425/378 R |
| 4,055,517 | 10/1977 | Daimer | 260/29.2 E |

*Primary Examiner*—Allan Lieberman
*Attorney, Agent, or Firm*—Brumbaugh, Graves, Donohue & Raymond

[57] ABSTRACT

A dispersion composition and a method for coating the surface of steel casting dies for molten metals are described. The dispersion composition comprises boron nitride powder dispersed in a peroxide-modified aqueous dispersion of a water-dispersible film-forming polymer. The coating composition provides thermal insulation to the mold surface, thereby minimizing premature solidification of the cast metal.

8 Claims, 2 Drawing Figures

WATER-DISPERSIBLE COATINGS CONTAINING BORON NITRIDE FOR STEEL CASTING DIES

BACKGROUND OF THE INVENTION

The present invention relates to the casting of metals in steel casting dies. In industrial die casting processes, molten metal is injected into a cavity formed by two sections of a steel casting die where the molten metal is allowed to solidify into a cast metal piece. The die sections, one stationary and one movable, contain tubes for circulating water to cool the sections in order to accelerate the solidification of the molten metal. After the molten metal has solidified, the steel casting die sections are separated and the cast metal piece is ejected.

Sometimes, molten metal freezes too rapidly, especially in thin sections of the casting. One of the undesirable effects caused by molten metals freezing too rapidly in the die cavity is the problem of "cold shuts" (i.e., obstruction of the flow of molten metal in the die by premature solidification, usually in the thin section of the casting) in which the metal solidifies prematurely thereby preventing complete filling of the die cavity. Also the metal may exhibit a patterned, rather than a smooth, surface on the piece. After extended use, the elevated temperatures and pressures involved in die casting processes can damage the steel casting dies and cause surface imperfections in the cast piece. In addition, fusion or sticking of the molten metal to the steel casting die surface can occur unless the die surface is first treated with a lubricant, antisticking agent or mold release composition.

As reported in Metals Handbook, the production of castings having thin sections presents problems in many cases because of temperature considerations. The temperature at which a die will operate during continuous operation depends on the weight of the "shot," the surface area of the shot, the cycle speed, and the shape of the die. When dies are too cold, cold shuts, laminations, internal incomplete filling and poor finishes with excessive flow marks are likely to result.

Cold shuts or flow marks in zinc alloy die castings also occur when the sprays of molten metal that first contact the surface of the die harden and are not remelted by the heat of the metal that later enters and fills the die cavity. The sprayed metal shows on the surface of the casting as laps or layers or as partly melted pieces embedded in the casting, or the cast part is incompletely formed due to incomplete filling of the die.

Some casting shapes require localized heating above the established temperature. Metal overflows are often used to heat die areas surrounding peripheries having thin casting sections far from the main runner. This method of local heating helps to fill thin casting sections and to improve casting finish. In the past, cold shuts have been eliminated by decreasing the cycle time to increase the die temperature; or by reducing coolant flow in the area of the die corresponding to the affected area of the casting; or by heating the die with external heaters.

Depending upon the particular conditions, the minimum thickness that can be produced in a zinc die casting is of the order of about 0.25 mm., usually around 0.5 mm. to 0.8 mm. As suggested above, the minimum thickness which can be tolerated is also a function of the physical size of the casting and other variables as well. It is castings of such thin sections to which one object of the present invention is directed because the thermal insulation provided by the die coatings of the present invention permits the use of thin casting sections while still avoiding the disadvantages of premature solidification of the molten metal, and avoiding the need for unusual measures such as extra heaters or die overflowing to avoid the cold shuts, etc. For example, use of the present invention permits the flow of molten metal into areas having constricted cross-sections, such as automotive radiator grills.

In the past, boron nitride has been used as a lubricant for industrial machinery because of its high temperature stability and thermal insulation properties. When used alone, however, boron nitride does not adhere effectively to the die surface, and it has been necessary to disperse it as a powder in a suitable carrier. In this regard, U.S. Pat. No. 2,726,160 describes a composition of boron nitride in water using an acetate of an acylated diamine as a dispersing agent. According to the patent, the composition is applied as a thin coating on casting molds for glass and metal. The coating is not expected to provide continuous protection for the mold and must be reapplied every several hours.

Various polymers have also been used as lubricants in the die casting of metals. When used alone, many polymers decompose, emit noxious fumes, or become tacky upon contact with molten metals. U.S. Pat. No. 2,923,041 relates to the treatment of metal casting molds for nonferrous metals using low molecular weight hydrocarbon polymers, such as polyisobutylenes and polyethylene. Alpha-olefinic polymers in organic diluents, including ketones, toluene and benzene, are disclosed in U.S. Pat. No. 3,253,932. Polyol esters of fatty acids are described as liquid lubricants in U.S. Pat. No. 3,620,290.

Other known coating compositions for coating metal casting molds include molybdenum disulfide in a polymer base as described in U.S. Pat. No. 3,447,588. A mixture of graphite, cryolite and a boron-containing compound for protecting the surface of a metal is described in U.S. Pat. No. 3,685,986. The boron-containing compound is either boron anhydride or boron ore. Casting molds containing silicon nitride are described in U.S. Pat. No. 3,709,459. In U.S. Pat. No. 3,727,666, a thin refractory composition, which may contain up to 5% of a water-based latex is used to prevent contamination of the molten metal and sticking of the metal at the casting mold surface. Finally, a coating of an inorganic binder and a metallic material or a solid lubricant for treating die surfaces is disclosed in U.S. Pat. No. 3,895,899. The patent describes the formation of a layer of nitride and borides as diffusion products which result from the simultaneous penetration of nitrogen and boron into the working surfaces of the mold.

Moreover, the foregoing prior art does not suggest any solution to the problem of premature solidification or "cold shuts" in die casting.

In the copending application of Schrade F. Radtke, Ser. No. 857,939, filed Dec. 6, 1977, which is incorporated herein by reference, there is disclosed and claimed a method for treating steel casting dies wherein a composition of boron nitride in an elastomeric polymer and an organic solvent is used. However, the use of organic solvents in a casting machine may create problems of toxic fumes and flammability (plus cost) which would require special precautions or special apparatus.

SUMMARY OF THE INVENTION

It is an object of the present invention to provide a steel casting die having a surface coating containing boron nitride such as to permit an injection of molten metal, allowing the metal to solidify into a cast metal piece without adhereing fully or locally to the coated casting die, such coating being applicable without the release of combustible or toxic solvent vapors which would endanger the safety of the coating and casting operation.

It is an object of the present invention, therefore, to base the nature of said surface coating on film-forming components, preferably of polymeric nature, which are water-dispersible. In contradistinction to the above-mentioned copending application of Schrade F. Radtke, Ser. No. 857,939, filed Dec. 6, 1977, in the present invention boron nitride is incorporated within such film-forming and water-dispersible polymers, instead of incorporating boron nitride in elastomeric polymers which require a dispersion in organic solvents.

The film-forming polymers used in the present invention consist of at least two fractions, namely, a low polymer fraction which is readily water-dispersible and a high polymer fraction which is dispersed within the low polymer sweller fraction and which is to serve in providing the needed strength and hardness to the applied coating. In view of the above fact, the present invention uses as water-dispersible polymers materials from the group of latexes, colloidal dispersion resins, water-dispersible alkyd resins and others. These polymers, in their initial commercial form (in spite of the use in their production of small amounts of initiators for the polymerization, which might include small amounts of peroxides eventually), still retain partially monomeric unsaturated components as another fraction. The unsaturated monomeric fraction is retained in order to assure commercially the highest degree of water-dispersibility.

Even though such commercial water-dispersible polymers are intended to form gradually adherent and dry coatings on substrates coated therewith, they are not suitable to do so on application to metal surfaces with such a degree of conversion into dry and adherent coatings that they would tolerate contact with molten metals without softening and without allowing such metal to adhere on cooling to such coated surfaces. Besides, such water-based polymers retaining an unsaturated monomeric fraction have the tendency to develop a low degree of adherence to smooth metal surfaces and have the tendency to recede locally from the edges of the coated metal surface. Therefore, they are not suitable to provide the ojects of the present invention.

However, the present invention has established that the water-dispersible polymers can be modified to eliminate the retained unsaturated monomeric fraction by polymerizing it and to increase further the degree of polymerization of the low polymeric fraction without losing the property of being water-dispersible film formers which allow the introduction therein of the boron nitride component for the coating of casting dies.

This modification is based on treating an aqueous dispersion of such polymer with a water-soluble peroxide, in particular hydrogen peroxide, which on heating to around 60° C. and above acts as an agent to polymerize further the water-dispersible film-forming polymer without losing its water-dispersible property. The amounts of peroxide required are such as to actually polymerize the monomeric and the low polymer fractions. Such amounts have been found to represent a minimum of at least about 3% of the polymer solids in the water-dispersed polymer. However, such amounts of peroxide are limited to a maximum amount which would avoid the promotion of the state of polymerization beyond the range of water-dispersibility, such maximum amount being about 7.5% of the polymer solids in the water-dispersed polymer. The amount of peroxide most effective for different water-dispersible polymers varies with the degree of unsaturation and reactivity of the materials, but remains within such limits between about 3% and about 7.5% of the amount of polymer solids in the water-dispersed polymer.

That such treatment with the hydrogen peroxide chemically modifies the water-dispersed polymer is evident in comparing the infrared absorption spectra of the polymer matter before and after the peroxide treatment. Before the treatment, the infrared absorption spectrum showed the residual unsaturation in the bands between 1770 and 1670 $cm^{-1}$ (Wave number) which bands are no longer present after the peroxide treatment.

The actual chemical modification is evident in the melting properties of the material as far as before the peroxide treatment the applied water-dispersed product—even when containing the boron nitride—will have the tendency to recede from the edges of the coated metal surface and will soften in contact with molten metal. On the other hand, after the peroxide treatment the applied coating adheres to the coated metal surface in a uniform manner and does not melt in contact with molten metal.

DETAILED DESCRIPTION OF THE INVENTION

Figure 1:
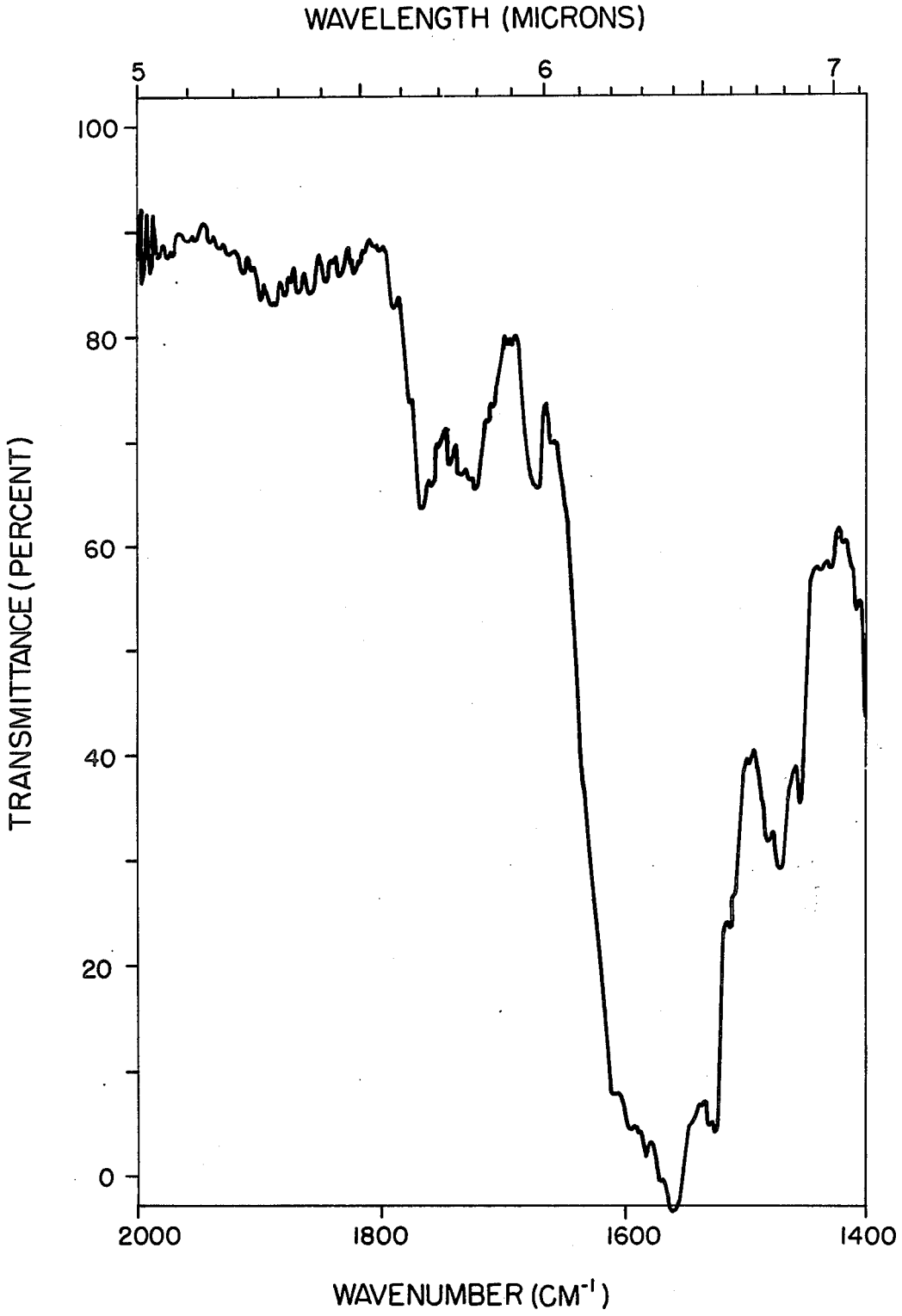

In accordance with the present invention, there is prepared a dispersion composition for coating the surface of a steel casting die for molten metals which comprises boron nitride powder dispersed in a peroxide-modified aqueous dispersion of a water-disersible film-forming polymer. The dispersion composition is prepared by treating an aqueous dispersion of a water-dispersible film-forming polymer having a high-polymer fraction, a low-polymer fraction and an unsaturated monomeric fraction with a water-soluble peroxide, such as hydrogen peroxide, under conditions that bring about the polymerization of the unsaturated monomeric fraction and the further polymerization of the low-polymer fraction without however losing the water-dispersible property of said polymer, and dispersing boron nitride powder in the resulting peroxide-modified aqueous dispersion of said polymer.

Thus, said aqueous dispersion of said polymer may be treated with hydrogen peroxide by mixing said dispersion with hydrogen peroxide (30%) and raising the temperature of the resulting mixture up to a temperature in the range of from about 60° C. to about 80° C. The amount of hydrogen peroxide used in treating said aqueous dispersion of said polymer may be from about 3 to about 7.5 parts by weight, expressed as 100% hydrogen peroxide, per 100 parts by weight of said polymer solids.

The dispersion composition is stirred or ball-milled for a sufficient time, for example, 1-20 hours, to obtain a uniform dispersion. The thus prepared dispersion composition comprises from about 10% to about 48% by weight of boron nitride powder, from about 10% to about 27% by weight of said peroxide-modified polymer and the balance substantially water as an aqueous dispersion medium. The aqueous dispersion medium may, however, contain small amounts of compatible adjuvants, where desired, such as antifoaming agents and wetting agents.

The resulting dispersion composition is then applied, e.g., by brushing or spraying, as a film onto the surface of a steel casting die which contacts the molten metal and allowed to dry at either room or elevated temperature, thus forming a thermally insulating, lubricating and protective coating on the die surface. The coating, which has a thickness ranging from about 0.02 millimeters to about 0.19 millimeters, comprises from about 36 to about 180 parts by weight of the peroxide-modified polymer per 100 parts by weight of boron nitride powder.

Figure 2:
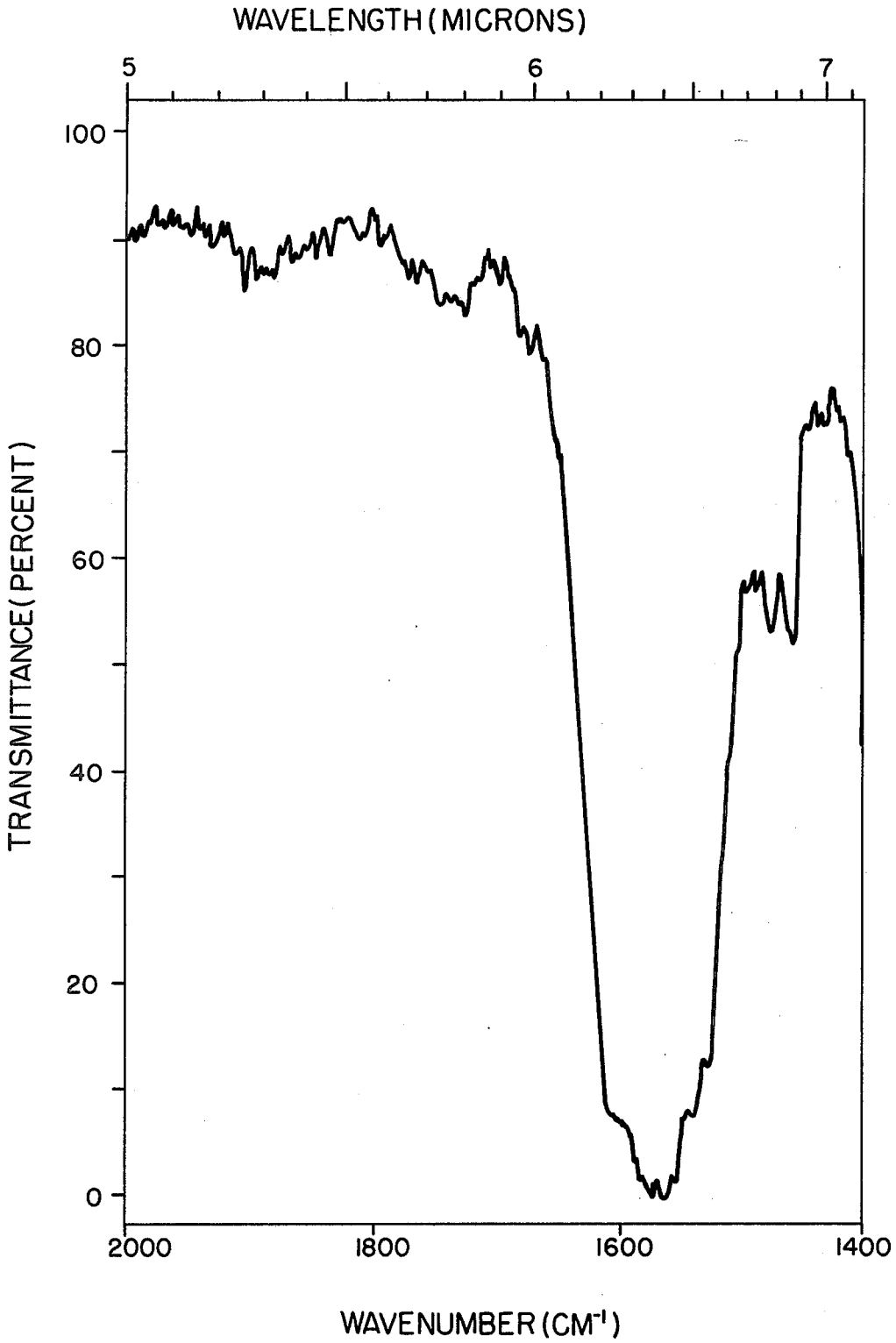

In the drawing,

FIG. 1 shows a portion of an infrared absorption spectrum between 2000 and 1400 $cm^{-1}$ (Wave number) (using a Perkin Elmer infrared grating spectrophotometer Model 621) of butadiene-acrylonitrile copolymer latex (Chemigum LCG 245) which has not been subjected to peroxide treatment, and FIG. 2 shows the same portion of an infrared absorption spectrum of such a copolymer which has been subjected to treatment with hydrogen peroxide (See Example 3 hereinafter).

Before the peroxide treatment (FIG. 1), the infrared absorption spectrum showed the residual unsaturations in the bands between 1770 and 1670 $cm^{-1}$ (Wave number) which bands are no longer present after the peroxide treatment (FIG. 2).

Although casting dies are typically made of steel, the coating composition may be applied to the surface of any casting die in which the premature solidification or the high temperatures of the molten metal may result in the undesirable effects mentioned above. The coating composition may be employed to improve the finish of any metal or metal alloy. Preferably, the composition is used to coat the surfaces of steel dies used in the casting of zinc and zinc alloys.

Boron nitride, which has the chemical formula BN, is combined as a powder with the peroxide-modified aqueous dispersion. Preferably, the boron nitride powder should be about 90% to 100% pure. However, variations in purity do not affect the usefulness of the present invention as long as the boron nitride powder exhibits the general properties of the compound, such as heat resistance and lubricity. The particle size of the boron nitride powder in the peroxide-modified aqueous dispersion should be less than about 200 mesh.

The present invention, as noted above, is directed to dispersions of boron nitride in water-dispersed film-formers, in order to produce the desired boron nitride coating on the steel casting dies. Such water-based film-formers include film-forming latexes, water-reducible resins (resin emulsions) and/or combinations of latexes and water-reducible resins, for example, acrylic polymers, alkyd resins, butadiene-acrylonitrile copolymers and noncarboxylated styrene-butadiene polymers.

Such commercial latexes which serve as the base material in preparing the compositions of the present invention are initially derived from a technique for the latex formation which represents an emulsion polymerization of the monomer components. Such monomers can be, for example, monomeric vinyl acetate, vinyl chloride, vinylidene chloride, esters of acrylic acid, styrene-butadiene emulsions or others. Such an initial latex represents a colloidal dispersion of spherical polymer particles in water. However, to use such initial latexes for coatings according to the present invention, they must have the optimum polymer properties for pigment binding, adhesion to the substrate, flexibility, etc. To obtain such a desired balance of properties to the coatings, the initial latex is in practice post-formulated before it is offered to the market as a latex for coating, and this applies to the requirements for the coatings of the present invention. This post formulation is carried out in practice by the use of emulsifiers (such as sodium lauryl sulfate) and by the use of activators (such as sodium formaldehyde sulfoxylate) and the use of chain transfer agents (such as t-doceyl mercaptan). To chemically initiate the beginning of the polymerization by a form of disscoiation of the initial monomer, very small amounts in the order of 0.2–0.5 parts of hydroperoxides or persulfates per 100 parts of monomer are used. Where these organoperoxides are used, they are used for influencing the organic monomers which are being used to initiate the formation of the latexes. Such very small amounts, however, are not sufficient or suitable for treating the polymers or resins to make them satisfactory for producing boron nitride coatings for steel casting dies to which the molten zinc will not adhere.

The new product of the present invention requires a different form of peroxide treatment of the commercial latex materials, thus to change the properties of the commercial latexes by chemically modifying the residual unsaturated monomers and low-polymer fraction which are generally a part of the emulsion polymerized latexes. By so polymerizing such residual unsaturated monomers and further polymerizing the low-polymer fraction, the product is obtained which is capable of meeting the requirements of boron nitride coating for steel casting dies.

This peroxide treatment or chemical modification of the film-forming latexes is based on its effect on the available unsaturation of the residual monomers. Although such unsaturation has in the past been used for analytical purposes, it has not been used in the sense of the utilization of the present invention. The present invention, therefore, aims to increase the polymeric state of the latex by treatment of the latex itself with a water-soluble peroxide, preferably hydrogen peroxide. By such a treatment the monomeric residual amount of the latex base material as well as any intermediate forms of polymerization as might occur during the emulsion polymerization of the starting materials into the latex form are transformed into a higher degree of polymer condition and into a form which is more uniform. Therefore, new properties are obtained and a more uniform vehicle is obtained which serves according to the present invention for the dispersion and as a carrier substance for the boron nitride in coatings for steel casting dies.

It is possible in accordance with the present invention also to utilize resins which are not in latex form but which are water-dispersible or water-reducible. Such water solutions or water dispersions include polymeric resins which are capable of water reductions with or without pH adjustments. They include soluble and semi-soluble resins. Although they do not include latex as such, they might have been initially derived from emulsion polymerization procedures. They are, however, powders ranging in particle size from 0.5 to 1.5

μm in diameter and therefore being in the colloidal range. Several of these water-reduced resins have been used successfully as vehicles for boron nitride coatings on steel. They have shown (like the latexes) that the molten zinc can melt into coatings based on such water-reducible resins when they have not been treated with peroxide. The molten zinc, however, does not stick to these water dispersion resin coatings which have been combined with boron nitride after the resins have been modified with the hydrogen peroxide treatment.

The following representative, but nonlimiting, examples will further illustrate the invention.

EXAMPLE 1

In this Example 1 a peroxide-modified acrylic polymer latex containing boron nitride was used as the coating composition.

The following Composition A of the invention was prepared by ball milling:

| | |
|---|---|
| 15 g | boron nitride (Type HCP) |
| 60 g | peroxide-modified acrylic polymer latex |
| 20 g | water |
| 3 g | antifoaming agent (NOPCO NXZ) |
| 98 g | Total |

The peroxide-modified acrylic polymer latex mentioned above was prepared from vinyl chloride acrylic (an ester of an acrylic acid) copolymer latex (HYCAR 2600×228). 170 g of the HYCAR latex 2600×228 having a solids content of 40–45% was mixed with 12 g of 30% hydrogen peroxide (7% of the latex) and heated with stirring to 60° C.–65° C.

Carbon steel panels having a thickness of 0.76–0.78 mm. were coated with Composition A to form a thin layer. After the coatings air dried, the thickness of the coated panels was measured with a microtest gage and the coating thickness was calculated by substracting the thickness of the uncoated panels from the thickness of the coated panels.

Zinc bars were melted in covered crucibles to minimize the zinc oxide formation and then poured onto the coated steel panels in drops measuring approximately 5 mm. deep. The molten zinc was allowed to cool and solidify on the coated panels. The cooling times were similar to those required in commercial casting procedures.

The observations made are reported in the following Table I wherein the numerical values are given in millimeters:

TABLE I

| Panel # | Thickness of Panel | Thickness of Coated Panel | With Applied Zinc | Discoloration of Reverse Side of Panel |
|---|---|---|---|---|
| 1A | 0.77<br>0.77 | 0.92<br>0.88<br>90 | One zinc application fell off - another stuck on | Reverse side clear |
| 1B | 0.78<br>0.76<br>0.78 | 0.94<br>0.92<br>0.88 | Zinc fell off (Underneath 0.83) | Reverse side clear |
| 1C | 0.78<br>0.77 | 0.89<br>0.87<br>0.85 | Zinc sticks to this thinner coating | Reverse side clear |

Since there was no discoloration of the reverse side of the coated steel panel due to heat transfer, the protective coating of the invention acted as a thermal insulator. Moreover, the coating also acted as a lubricant, i.e., the zinc fell off on cooling for those steel panels having a sufficient coating thickness.

EXAMPLE 2

In this Example 2 a coating composition comprising a peroxide-modified noncarboxylated styrene-butadiene polymer latex and boron nitride was compared with such a coating composition wherein the polymer latex had not been treated with a peroxide.

A noncarboxylated styrene-butadiene polymer latex (67-33) was used to prepare a coating composition. It was supplied as Darex 620 L by Polymer-Chemical Division of W. R. Grace & Company containing 42% solids. This was found to be a very reactive latex and showed a tendency to form conglomerates during the treatment with hydrogen peroxide. The peroxide treatment was made with 120 parts by weight of noncarboxylated styrene-butadiene polymer latex (42% solids) and 5.5 parts by weight of hydrogen peroxide (30%). Due to the high reactivity of the latex, the heating was limited to 65° C. during the peroxide treatment. Even then, however, some clumps were formed where the reaction had progressed further (for example, at the bottom of the reaction vessel). The following coating compositions were made:

| Composition B (without peroxide treatment) | | Composition C (with peroxide treatment) |
|---|---|---|
| 18 g | Boron Nitride (Type HCV) | 18 g |
| 81 g | Styrene Butadiene Polymer Latex - 42% Solids | 70 g |
| 20 g | Water | 20 g |
| 4 g | Antifoaming Agent (NOPCO NXZ) | 3.5 g |
| 123 g | Total | 111.5 g |

When comparative Composition B (without peroxide treatment) was applied to the steel panels of the type used in Example 1, the film tended to crack and fall off. Moreover, when molten zinc was applied as in Example 1 to the air dried coating surface, the zinc stuck to the steel panel and where the zinc had then been removed, the boron nitride coating stuck to the zinc. However, in the case of Composition C of the invention (with peroxide treatment) the zinc did not adhere to the coating except where clumps of material had formed on the steel surface without any adherent boron nitride coating. The following Table II gives a report of the measurement of the coated panel thicknesses.

TABLE II

| | Thickness in mm ("National" Gage) | | | | | | |
|---|---|---|---|---|---|---|---|
| | Coated Panels B (without peroxide treatment) | | | | Coated Panels C (with peroxide treatment) | | |
| Steel panel itself | | 0.28 | | | 0.28 | | |
| 2A | 0.52 | 0.48 | 0.54 | 0.49 | 0.47 | 0.31 | 0.38 |
| 2B | 0.52 | 0.51 | | | 0.43 | 0.38 | |
| WHERE ADHERENT ZINC LATER FELL OFF REMAINING: | | 0.30 | 0.32 | | UNDER FALLEN OFF ZINC: | 0.42 | |

Before the molten zinc was applied to the coated steel panels, a white paper was laid underneath the panels. After the tests, the paper under comparative Composition B showed discolored areas where the zinc had been applied. There were, however, no discolored areas on the paper under the steel panels which had been coated with Composition C of the invention. This shows that the Composition C of the invention possessed superior thermal insulating properties.

The foregoing comparative data illustrate the fact that peroxide treatment of the aqueous disperson of a water-dispersible film-forming polymer (in which boron nitride is subsequently dispersed) is essential to the preparation of a suitable coating composition for a steel casting die.

EXAMPLE 3

In order to determine the chemical influence of the peroxide treatment on the polymer the following tests were made: a butadiene-acrylonitrile copolymer latex (Chemigum LCG 245-Goodyear) containing 43% solids was used. It was heated with 8% hydrogen peroxide (30%) to 80° C.

Both the peroxide-modified latex and a separate sample to which the peroxide treatment was not applied were analyzed.

The untreated latex as well as the peroxide-modified latex were somewhat diluted with water, i.e., the untreated latex with 10 g water and the treated latex with 20 g water to 125 g latex. The latex was then shaken with ethyl ether in order to extract the soluble fractions from the water dispersion into the ethyl ether. The purpose was to extract the unsaturated monomeric fraction and the low-polymer fraction of the polymer. The high-polymer fraction of such polymers, on the other hand, is poorly soluble or insoluble in ethyl ether.

The ether was evaporated off from each of the respective samples and the solids obtained were redispersed in carbon tetrachloride. These samples were then well suitable for comparing the extracted product without peroxide treatment with the extracted product after peroxide treatment using infrared absorption spectra with the Perkin Elmer infrared grating spectrophotometer Model 621. The portions of the infrared absorption spectra diagrams between 2000 and 1400 $cm^{-1}$ (Wave number) obtained on the untreated sample and obtained on the peroxide-treated sample are shown in FIG. 1 and FIG. 2, respectively. Upon comparison of the spectra, it is evident that the peroxide untreated polymer has some well developed bands between 1770 and 1670 $cm^{-1}$ (Wave number) showing residual unsaturation, which bands are no longer present after the peroxide treatment. There are other changes (not shown) also at other wave numbers (2200–2400 $cm^{-1}$). This establishes that the peroxide treatment actually chemically modified the polymer of the latex.

In the following Examples 4 and 5 the boron nitride was pretreated with lecithin and a synthetic wetting agent before dispersing it in a peroxide-modified aqueous dispersion of a water-dispersible film-forming polymer.

EXAMPLE 4 a peroxide-modified polymer composition containing boron nitride pretreated with lecithin and a synthetic wetting agent according to the invention (Composition E) was compared with another composition containing boron nitride pretreated with lecithin and a synthetic wetting agent but without a film-forming polymer (comparative Composition D). In each case, the compositions were prepared according to the formulations given below.

Carbon steel panels having a thickness of 0.78–0.80 mm. were separately coated with either comparative Composition D or Composition E to form a thin layer. After the coatings dried, the coating thickness was determined as in Examples 1 and 2.

Molten zinc was applied to the coated panels as in Examples 1 and 2.

The following comparative Composition D, which was ball milled with steel balls, was used:

| | |
|---|---|
| 30 g | boron nitride (Type HCP) dispersed in |
| 8 g | water-dispersible lecithin (Alcolec 439 C) consisting of<br>85% oil carrier type lecithin (bleached crude soybeam lecithin Alcolec BS) and<br>15% synthetic wetting agent (substituted polyether) as a mixture of octylphenol polyether (Triton X-45) and alkylaryl polyether (Triton X-100) (1:1) |
| 38 g | Total |

The thickness on the coated steel panel was about 0.82 mm. after air drying and also after air drying followed by oven drying at 54° C. for 30 minutes. The surface where molten zinc was applied had a coated thickness of 0.80 mm. The molten zinc which was poured onto the so-treated panel did not stick to the surface of the steel. However, the adherence of the coating to the steel was limited, because under the pressure of the thickness gage the coating tended to lose adherence.

The coating Composition D described above was modified by the addition of an acrylic polymer latex treated with hydrogen peroxide. Thus 170 grams of acrylic polymer latex (Rhoplex AC 235—a polyester of an acrylic acid) having a solids content of 46–47% and a pH of 9.5 was mixed with 10 grams of 30% hydrogen peroxide and heated under stirring and strong foaming to 60° C. This peroxide-modified acrylic polymer latex was used to modify the coating Composition D and thus form Composition E of the invention as follows:

| | |
|---|---|
| 91 g | of Composition D |
| 40 g | acrylic polymer latex treated with hydrogen peroxide |
| 20 g | water |
| 151 g | Total |

Test panels were coated in accordance with the procedures described above and, after drying, molten zinc was poured thereon. The results of the tests are set forth in the following Table IV wherein the numerical values are given in millimeters:

TABLE IV

| Panel # | Thickness of Panel | Thickness of Coated Panel | Without Zinc | Under Applied Zinc |
|---|---|---|---|---|
| 4A | 0.78 | 0.92 | Heavy Coating | 0.83 |
| | | | 0.93 | |
| | | | 0.98 | |
| | | | 0.85 | |
| 4B | 0.78 | 0.82 | Thinner Coating | |
| | | | No Sticking of Zinc | |
| | | | Coating Adheres to Steel | |
| | | | 0.82 | 0.81 |
| | | | 0.83 | |
| | | | 0.83 | |

TABLE IV-continued

| Panel # | Thickness of Panel | Thickness of Coated Panel | Without Zinc | Under Applied Zinc |
|---|---|---|---|---|
| 4C | 0.78 | 0.81 | No Sticking of Zinc Coating Adheres to Steel | |
| | | | 0.81 | 0.80 |
| | | | 0.80 | |
| | | | 0.81 | |
| 4D | 0.79 | 0.81 | No Sticking of Zinc Coating Adheres to Steel | |
| | | | 0.81 | 0.79 |
| | | | 0.81 | |
| | | | 0.80 | |
| 4E | 0.80 | 0.82 | No Sticking of Zinc Coating Adheres to Steel | |
| | | | 0.83 | 0.80 |
| | | | 0.81 | |
| | | | 0.83 | |

Results of this example show that a coating of Composition E of the invention adhered to the steel panel, resisted the application of molten zinc thereto and acted as a lubricant for the zinc which did not stick to the coating. The foregoing comparative data further illustrate the fact that the boron nitride dispersion must contain a peroxide-modified aqueous dispersion of a water-dispersible film-forming polymer.

EXAMPLE 5

The following mixture was ball milled with steel balls:

| | |
|---|---|
| 35 g | boron nitride (Type HCP) dispersed in |
| 10 g | water-dispersible lecithin (Alcolec 439 C) consisting of |
| | 85% oil carrier type lecithin (bleached crude soybean lecithin Alcolec BS) and |
| | 15% synthetic wetting agent (substituted polyether) as a mixture of octylphenol polyether (Triton X-45) and alkylaryl polyether (Triton X-100) (1:1) |
| 20 g | water |
| | For the above mixture there was then added: |
| 35 g | acrylic polymer latex treated with hydrogen peroxide |
| 20 g | water |
| 120 g | Total |

The acrylic polymer latex described above is vinylchloride acrylic (an ester of an acrylic acid) copolymer latex (HYCAR 2600×228). 170 g of the HYCAR latex 2600×228 having a solids content of 40–45% was mixed with 12 g of 30% hydrogen peroxide (7% of the latex) and heated with stirring to 60° C.–65° C. This Composition F of the invention was applied to the steel panels and dried as described in Example 1 and produced good dry adherent coatings. The following Table V summarizes the results after molten zinc was applied to the steel panels wherein the numerical values are given in millimeters:

TABLE V

| Panel # | Thickness of Panel | Thickness of Coated Panel | With Applied Zinc | Discoloration of Reverse Side of Panel |
|---|---|---|---|---|
| 5A | 0.78 | 0.85 | No Zinc Applied | |
| | | 0.83 | | |

TABLE V-continued

| Panel # | Thickness of Panel | Thickness of Coated Panel | With Applied Zinc | Discoloration of Reverse Side of Panel |
|---|---|---|---|---|
| | | 0.85 | | |
| 5B | 0.77 | 0.87 | Zinc Fell Off | Reverse Side Clear |
| | 0.77 | 0.84 | | |
| | | 0.86 | | |
| 5C | 0.77 | 0.84 | Zinc Fell Off | Reverse Side Nearly Clear |
| | 0.77 | 0.85 | | |
| | | 0.88 | | |

Since there was essentially no discoloration of the reverse side of the coated steel panel due to heat transfer, the protective coating of the invention acted as a thermal insulator. Also the coating acted as a lubricant, i.e., the zinc fell off on cooling.

The foregoing data and that for Compositon E of Example 4 show that the boron nitride can be pretreated with lecithin and a synthetic wetting agent prior to incorporation into a peroxide-modified aqueous dispersion of a water-dispersible film-forming polymer.

In the following Example 6 the boron nitride was pretreated with a synthetic wetting agent alone before dispersing it in a peroxide-modified aqueous dispersion of a water-dispersible film-forming polymer.

EXAMPLE 6

Coating Composition G similar to Composition D described in Example 4 was prepared having the following components:

| | |
|---|---|
| 30 g | boron nitride (Type HCP) directly dispersed in |
| 10 g | synthetic wetting agent (substituted polyether) as a mixture of octylphenol polyether (Triton X-45) and alkylaryl polyether (Triton X-100) (1:1) |
| 100 g | additional water |
| 140 g | Total |

The comparative Composition G was ball milled with steel balls and applied to two steel panels. One panel was air dried; the other was air dried and then dried in an oven at 54° C. for 30 minutes. The coating thickness of the air dried sample was 0.84 mm. and the sample that was air dried and oven dried had a coating thickness of 0.85 mm. The surface where the molten zinc was applied had a coating thickness of 0.83 mm. and 0.84 mm., respectively. The two coatings, however, fell off easily under the pressure of the thickness gage.

The Composition G described above in this example was mixed with additional components to form a Composition H of the invention as follows:

| | |
|---|---|
| 105 g | of Composition G |
| 40 g | of the acrylic polymer latex treated with hydrogen peroxide in accordance with the procedure described in Example 4 |
| 25 g | water |
| 170 g | Total |

This Composition H was applied to steel panels in the manner described in Example 4 and the results are set forth in the following Table VI wherein the numerical values are given in millimeters:

TABLE VI

| Panel # | Thickness of Panel | Thickness of Coated Panel | Without Zinc | Under Applied Zinc |
|---|---|---|---|---|
| 6A | 0.78 | 0.82 | No Sticking of Zinc but Discoloration in Spots | |
| | | | 0.82 | 0.80 |
| | | | 0.80 | |
| | | | 0.83 | |
| 6B | 0.78 | 1.02 | Heavy Application | Zinc Stuck on Panel |
| | | | 0.99 | |
| | | | 1.05 | |
| | | | 1.03 | |
| 6C | 0.79 | 0.81 | No Sticking of Zinc | |
| | | | 0.82 | 0.80 |
| | | | 0.81 | |
| | | | 0.81 | |

It is observed, therefore, that the pretreating of boron nitride with a synthetic wetting agent alone produces a coherent and adherent coating in combination with the peroxide-modified acrylic polymer latex. The data also indicate that too thick a coating may be inappropriate to use.

EXAMPLE 7

A composition was prepared in which an acrylic colloidal dispersion resin was the basic component. This was Acrysol WS 12 resin (Rohm & Haas Company) which is industrially obtainable with 29–31% solids content in the dispersion. The dispersion contains, as solvents, 9 parts of water and 1 part of t-butanol. It was used either without hydrogen peroxide treatment (comparative Composition I) or it was treated with hydrogen peroxide using 110 g Acrysol WS 12 dispersion and 8 parts of 30% hydrogen peroxide with heating up to 80° C. (Composition J of the invention). The following compositions were then prepared by ball milling for 20 hours:

| | Not Peroxide Treated (Composition I) | Peroxide Treated (Composition J) |
|---|---|---|
| Boron Nitride (Type HLV) | 15 g | 15 g |
| Acrysol WS 12 | 60 g | 52 g |
| Water | 20 g | 20 g |
| Antifoaming Agent (Nopco NXZ) | 3 g | 3 g |
| Total | 98 g | 90 g |

The compositions were applied to steel panels and it was observed that the nonperoxide-treated coating (comparative Composition I) tended to run off the edges of the steel panel. Moreover, the molten zinc which was subsequently applied stuck to the coating. On storing of the coated panels the coating tended to crack and fall off the surface. Moreover, when the adherent zinc was forced off the panel, the boron nitride stuck to the zinc.

The peroxide-treated Composition J of the invention, became very viscous and required the addition of 10 g additional water as diluent at which point it was still somewhat conglomerated. It did, however, form adherent coatings on the steel panels. When molten zinc was applied to the coating, the zinc did not stick to the coating but fell off. Although the coating was not very uniform on the steel panel, the zinc did not stick to the coating and where the zinc had been applied, it afterwards did not show any boron nitride on the reverse side of the zinc. In other words, the boron nitride coating remained on the steel panel after the zinc had been removed. The thicknesses of the coatings were measured and are reported in the following Table VII wherein the numerical values are given in millimeters:

TABLE VII

| | Thickness without Peroxide Treatment | | Thickness with Peroxide Treatment | | |
|---|---|---|---|---|---|
| Bare Steel Panel | 0.28 | | 0.28 | | |
| Panel 7A With Coating | 0.52 | 0.48 | 0.47 | 0.36 | 0.31 |
| | | | (These variations are caused by the fact that the boron nitride-latex coating tends in the case to form some clumps which influence the thickness readings) | | |
| Panel 7B With Coating | 0.54 | 0.49 | 0.43 | 0.38 | |
| | | | Even where the zinc had been poured on: 0.42 | | |
| Panel 7C With Coating | 0.52 | | | | |
| | Where the zinc had been stuck and was lifted off, remained | | Thickness influenced by some clumping of the BN: | | |
| | 0.30 | 0.39 | 0.34 | 0.31 | |
| | | | Where clumps interfered with the film formation of the latex-BN coating, the zinc can stick to the uncoated steel. | | |

EXAMPLE 8

In this Example 8 a water-dispersible alkyd resin was used as the film-forming polymer.

The following comparative Composition K was prepared:

| | |
|---|---|
| 15 g | boron nitride (Type HCP) |
| 40 g | water-dispersible alkyd resin (Arolen 585) (45% solids-triethyl amine solubilizer) |
| 20 g | additional water |
| 4 g | antifoaming agent (NOPCO NXZ) |
| 79 g | Total |

The Composition K was ball milled with steel balls to disperse the solids into liquid phase. The Composition K was applied to steel panels of the type described in Example 1. Some of the steel panels were merely air dried and other panels were air dried and then subsequently oven dried at 54° C. for 30 minutes. The air dried coatings averaged 1.1 mm. thickness and the air dried and oven dried coatings averaged 1.0 mm. thickness. Molten zinc was applied to the coated steel panels. With the air dried coating, the zinc melted into the steel panel and with the air dried/oven dried coating, the zinc melted into the steel panel but fell off locally leaving a coating under the place where the zinc had been applied of 0.96 mm. thickness.

In comparison with the foregoing, the same water-dispersible alkyd resin (Arolon 585) was treated by mixing 133 g of the alkyd solution (45% solid) with 13 g of a 30% hydrogen peroxide aqueous solution (10% of emulsion). The mixture was heated to 60°-65° C. which produced heavy foaming of the mixture. This peroxide-modified alkyd resin was used to prepare the following mixture:

| | |
|---|---|
| 15 g | boron nitride (Type HCP) |
| 40 g | hydrogen peroxide-modified alkyd resin (Arolon 585) (45% solids-triethyl amine solubilizer) |
| 20 g | water |
| 4 g | antifoaming agent (NOPCO NXZ) |
| 79 g | Total |

The mixture was ball milled to produce uniform dispersion and diluted with an additional amount of 20 g water to form Composition L of the invention. Peroxide treatment which was applied to the alkyd resin caused a polymerization of the low-polymer alkyd fraction and the unsaturated monomeric fraction, without going so far as to make the alkyd resin nonwater-dispersible. The peroxide-modified Composition L of the invention was applied to steel panels of the type described in Example 1 and the following results were obtained after molten zinc was applied to the steel panels wherein the numerical values are given in millimeters:

TABLE VIII

| Panel # | Thickness of Panel | Thickness of Coated Panel | With Applied Zinc | Discoloration of Reverse Side of Panel |
|---|---|---|---|---|
| 8A | 0.77 | 0.84 | No Zinc Applied | |
| | 0.77 | 0.83 | (coating was not | |
| | | 0.84 | very smooth) | |
| 8B | 0.77 | 0.84 | Zinc Fell Off | Reverse Side |
| | 0.77 | 0.82 | | Clear |
| | 0.77 | 0.82 | | |
| 8C | 0.77 | 0.83 | Zinc Fell Off | Reverse Side |
| | 0.77 | 0.81 | | Clear |
| | | 0.79 | | |

The foregoing comparative data further establish the necessity of using a peroxide-modified aqueous dispersion of a water-dispersible film-forming polymer in conjunction with boron nitrides to prepare a suitable coating composition for steel casting dies.

In the following Example 9 a mixture of peroxide-modified aqueous dispersions of water-dispersible film-forming polymers in conjunction with boron nitride was used to prepare the coating composition.

EXAMPLE 9

The following Composition M of the invention was prepared by ball milling:

| | |
|---|---|
| 45 g | peroxide-modified alkyd resin Composition L described in Example 8 |
| 20 g | peroxide-modified acrylic polymer latex (UCAR Latex 4358-45% solis) |
| 65 g | Total |

The peroxide-modified acrylic polymer latex used in this Composition M was made by mixing 160 parts by weight of UCAR Latex 4358 (45% solids) having a pH of 8.6 with 8 parts by weight of 30% hydrogen peroxide (5% of the latex) and heating the mixture to 60° C.-65° C. This Composition M was applied to steel panels of the type described in Example 1, dried and molten zinc was poured on the coated steel panels. The results observed are presented in the following Table IX wherein the numerical values are given in millimeters:

TABLE IX

| Panel # | Thickness of Panel | Thickness of Coated Panel | With Applied Zinc | Discoloration of Reverse Side of Panel |
|---|---|---|---|---|
| 9A | 0.78 | 0.81 | Zinc Fell Off | Reverse Side |
| | 0.78 | 0.81 | (Thickness below | Clear |
| | | 0.83 | was 0.81) | |
| 9B | 0.77 | 0.83 | Zinc Fell Off | Reverse Side |
| | 0.78 | 0.85 | | Slight Dis- |
| | | 0.84 | | coloration |
| 9C | 0.77 | 0.80 | Zinc Stuck to | Reverse Side |
| | 0.77 | 0.80 | Thin Film | Clear |
| | | 0.81 | | |

Comparison tests showed that steel panels coated with a mixture of nonperoxide treated water-dispersible alkyd resin and peroxide-modified acrylic polymer latex permitted the molten zinc to penetrate to the surface of the steel panel.

In a further embodiment of the present invention, the coating compositions can contain an iron oxide pigment, such as a red, yellow or black iron oxide, in an amount up to about 50% of the amount of boron nitride powder. Such usage has the advantages of lowering the cost of the die coatings, preventing soiling of the die coatings during normal handling of the dies, reducing discoloration caused by contact of molten zinc with the die coatings and preserving the appearance of the dies after previous uses. This is illustrated by the following Example 10.

EXAMPLE 10

A coating composition was prepared as follows:

| | |
|---|---|
| 360 g | boron nitride (Type HCN) was dispersed by ball milling with |
| 60 hg | water-dispersible lecithin (Alcolec 439c) consisting of |

-continued

| | | |
|---|---|---|
| | 51 g | oil carrier type lecithin (bleached crude soybean lecithin Alcolec BS) and |
| | 9 g | synthetic wetting agent (substituted polyether) as a mixture of octylphenol polyether (Triton X-45) and alkylaryl polyether (Triton X-100) (1:1) and |
| | 140 g | water |
| | 560 g | Total |
| These | 560 g | milling paste were diluted with |
| | 70 g | water and this was dispersed into |
| | 450 g | peroxide-modified acrylic polymer latex. |
| | 1080 g | Total |

The peroxide-modified acrylic polymer latex was prepared by heating 500 g. of acrylic polymer latex (Rhoplex AC 235—a polyester of an acrylic acid) with 30 g of hydrogen peroxide (30%) to above 60° C.

The mixture was ball milled again for a short time.

120 g of the above resulting composition was mixed with 6 g synthetic red iron oxide (MAPICO RED 347) and ball milled again for about an hour.

This red colored coating Composition N was applied to steel panels and allowed to dry to a coating thickness of about 0.1 mm. The applied zinc did not stick to the coating. There was hardly any discoloration visible at the contact area and there was no discoloration visible where the coated steel panel had been handled repeatedly.

In the above Example 10 the iron oxide pigment was added to the previously prepared coating composition. However, the iron oxide pigment can be added during, rather than after, the preparation of the coating composition as shown by the following EXAMPLE 11.

A coating composition was prepared by mixing

| | |
|---|---|
| 312 g | dry boron nitride (Type HCN) with |
| 48 g | synthetic red iron oxide (MAPICO RED 347) and adding |
| 60 g | water-dispersible lecithin (Alcolec 439c) consisting of |
| 51 g | oil carrier type lecithin (bleached crude soybean lecithin Alcolec BS) and |
| 9 g | synthetic wetting agent (substituted polyether) as a mixture of octylphenol polyether (Triton X-45) and alkylaryl polyether (Triton X-100) (1:1) and |
| 210 g | water |
| 630 g | Total |

This mixture was ball milled and then there was added thereto

| | |
|---|---|
| 450 g | peroxide-modified acrylic polymer latex |
| 1080 g | Total |

The peroxide-modified acrylic polymer latex was prepared by heating 500 g of acrylic polymer latex (Rhoplex AC 235)—a polyester of an acrylic acid) with 30 g of hydrogen peroxide (30%) to above 60° C.

The resulting mixture was ball milled again for a short time.

This red colored coating Composition O was applied to steel panels and allowed to dry to a coating thickness of about 0.1 mm. Molten zinc was poured over the coated steel panels. In none of the cases did the zinc blob adhere, on cooling, to the coated surface.

What is claimed is:

1. A process for the preparation of a dispersion composition for coating the surface of a steel casting die for molten metals, which comprises treating an aqueous dispersion of a water-dispersible film-forming polymer having a high fraction, a low polymer fraction and an unsaturated monomeric fraction with a water-soluble peroxide in an amount of from about 3 to about 7.5 parts by weight of the peroxide per 100 parts by weight of the polymer solids so as to bring about the polymerization of the unsaturated monomeric fraction and the further polymerization of the low polymer fraction without however losing the water-dispersible property of the polymer, and mixing from about 10% to about 48% by weight of boron nitride powder having a particle size less than 200 mesh with the resulting peroxide-modified aqueous dispersion containing from about 10% to about 27% by weight of the peroxide-modified polymer, the balance of the peroxide-modified aqueous dispersion being substantially water.

2. The process according to claim 1 wherein the water-dispersible film-forming polymer is selected from the group consisting of an acrylic polymer, an alkyd resin, a butadiene-acrylonitrile copolymer and a noncarboxylated styrene-butadiene polymer.

3. The process according to claim 1 wherein the water-soluble peroxide is hydrogen peroxide.

4. The process according to claim 3 wherein the aqueous dispersion of the water-dispersible film-forming polymer is treated with hydrogen peroxide having a concentration of about 30% by mixing said dispersion with hydrogen peroxide and raising the temperature of the resulting mixture up to a temperature in the range of from about 60° C. to about 80° C.

5. The process according to claim 1 which further comprises mixing an iron oxide pigment with the peroxide-modified aqueous dispersion in an amount up to about 50% of the amount of boron nitride powder.

6. The process according to claim 5, wherein the iron oxide pigment is mixed with the peroxide-modified aqueous dispersion after the mixing of the boron nitride powder with the peroxide-modified aqueous dispersion.

7. The process according to claim 5, wherein the iron oxide pigment and the boron nitride powder are simultaneously mixed with the peroxide-modified aqueous dispersion.

8. A dispersion composition for coating the surface of a steel casting die for molten metals produced by the process defined by claim 1 or claim 5.

* * * * *

UNITED STATES PATENT AND TRADEMARK OFFICE

CERTIFICATE OF CORRECTION

PATENT NO. : 4,195,002

DATED : March 25, 1980

INVENTOR(S) : Schrade F. Radtke et al

It is certified that error appears in the above–identified patent and that said Letters Patent are hereby corrected as shown below:

Col. 14, line 6, "HLV" should read -- HCV --. Col. 16, line 66, "HCN" should read -- HCV --. Col. 17, line 45, "HCN" should read -- HCV --

Signed and Sealed this

*Fifteenth* Day of *July 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,195,002

DATED : March 25, 1980

INVENTOR(S) : Schrade F. Radtke et al

It is certified that error appears in the above-identified patent and that said Letters Patent are hereby corrected as shown below:

Col. 3, line 52, "ojects" should read -- objects --. Col. 6, line 17, "disscoiation" should read -- dissociation --. Col. 7, line 59, "90" should read -- 0.90 --. Col. 8, line 38, a line should appear above "111.5 g". Col. 9, line 60, "a" should read -- A --. Col. 10, line 15, "soybeam" should read -- soybean --. Col. 15, line 3, "Arolen" should read -- Arolon --. Col. 16, line 17, "solis" should read -- solids --; line 68, "60 hg" should read -- 60 g --. Col. 17, between lines 41 and 42, insert the heading -- EXAMPLE 11 --. Col. 18, line 21, after "high" insert -- polymer --.

Signed and Sealed this

*Second* Day of *September 1980*

[SEAL]

*Attest:*

SIDNEY A. DIAMOND

*Attesting Officer*

*Commissioner of Patents and Trademarks*